US005884795A

United States Patent [19]

Godbersen et al.

[11] Patent Number: 5,884,795

[45] Date of Patent: Mar. 23, 1999

[54] COMBINED SEAT BENCH STORAGE APPARATUS

[76] Inventors: Bruce L. Godbersen, 282 LaJune Ave.; Byron L. Godbersen, Lake LaJune Estates, both of Ida Grove, Iowa 51445

[21] Appl. No.: 895,724

[22] Filed: Jul. 17, 1997

[51] Int. Cl.[6] ..... B65D 25/20

[52] U.S. Cl. ..... 220/23.86; 297/188.1; 297/188.07

[58] Field of Search ..... 297/188.1, 188.09, 297/188.08, 188.07, 188.04, 188.01; 220/23.86

[56] References Cited

U.S. PATENT DOCUMENTS

| | | |
|---|---|---|
| 65,937 | 6/1867 | Nye . |
| 629,204 | 7/1899 | Pattee . |
| 986,686 | 3/1911 | Carney . |
| 1,309,097 | 7/1919 | Markwick . |
| 3,839,757 | 10/1974 | Grimes . |
| 5,048,639 | 9/1991 | Scherer . |
| 5,050,767 | 9/1991 | Peer . |
| 5,275,018 | 1/1994 | Lin et al. . |
| 5,395,157 | 3/1995 | Rollo et al. . |
| 5,435,643 | 7/1995 | Kennedy . |

*Primary Examiner*—Stephen Castellano
*Attorney, Agent, or Firm*—Henderson & Sturm

[57] ABSTRACT

A seat locker assembly having an integrally formed base unit with a vented storage locker formed therein which is open at the top, an integrally formed unit including a seat, backrest and armrests pivotally connected to the front of the base unit for opening and closing thereover, and with fluid drain openings formed at the juncture of the seat and backrest for draining fluid from the seat downwardly for discharge at the rear of the backrest and over a rear lip of the base unit.

9 Claims, 5 Drawing Sheets

COMBINED SEAT BENCH STORAGE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

AUTHORIZATION PURSUANT TO 37 C.F.R. §1.71 (d) (e)

Not Applicable

BACKGROUND OF THE INVENTION

1. Technical Field

The present invention is directed to a combination apparatus which acts as a portable seat bench and storage locker. More specifically, the present invention includes an integrally formed rectangular storage locker having an open top, but which open top is normally sealingly closed by an integrally formed seat bench pivotally attached to the front of the locker, and movable between a closed position relative to the locker and an open position relative thereto.

2. Description of the Prior Art

Portable coolers, insulated storage chests, combined seats and containers are commonly known for storing and insulating items of food, beverage or the like; however, such products normally contain numerous, interworking parts requiring constant maintenance and such products do not provide a comfortable seat bench with provisions for storage below the seat.

BRIEF SUMMARY OF THE INVENTION

The present invention is a combination portable seat unit having a seat, backrest and arm rests pivotally attached to the top of a storage locker having an open top closeable in a sealing manner by the seat unit. The storage locker consists of a one-piece polyethylene rotational molded storage locker or base unit to which is pivotally mounted a one-piece polyethylene rotational molded seat unit having a seat, backrest and arm rests. Access is provided for the user to storage items in the base unit by lifting the seat unit from the base unit and rotating the one-piece seat unit upwardly to expose the base unit opening.

The base unit is provided with air vents for interior ventilation, hand holds for carrying purposes. Both the base and seat units have upper and lower, respectively, interlocking lips for sealing purposes, with the seat unit provided with drain openings at the juncture of the seat and backrest for water drainage, the openings working in conjunction with the base unit rear lip.

DETAILED DESCRIPTION OF THE INVENTION

Figure 1:
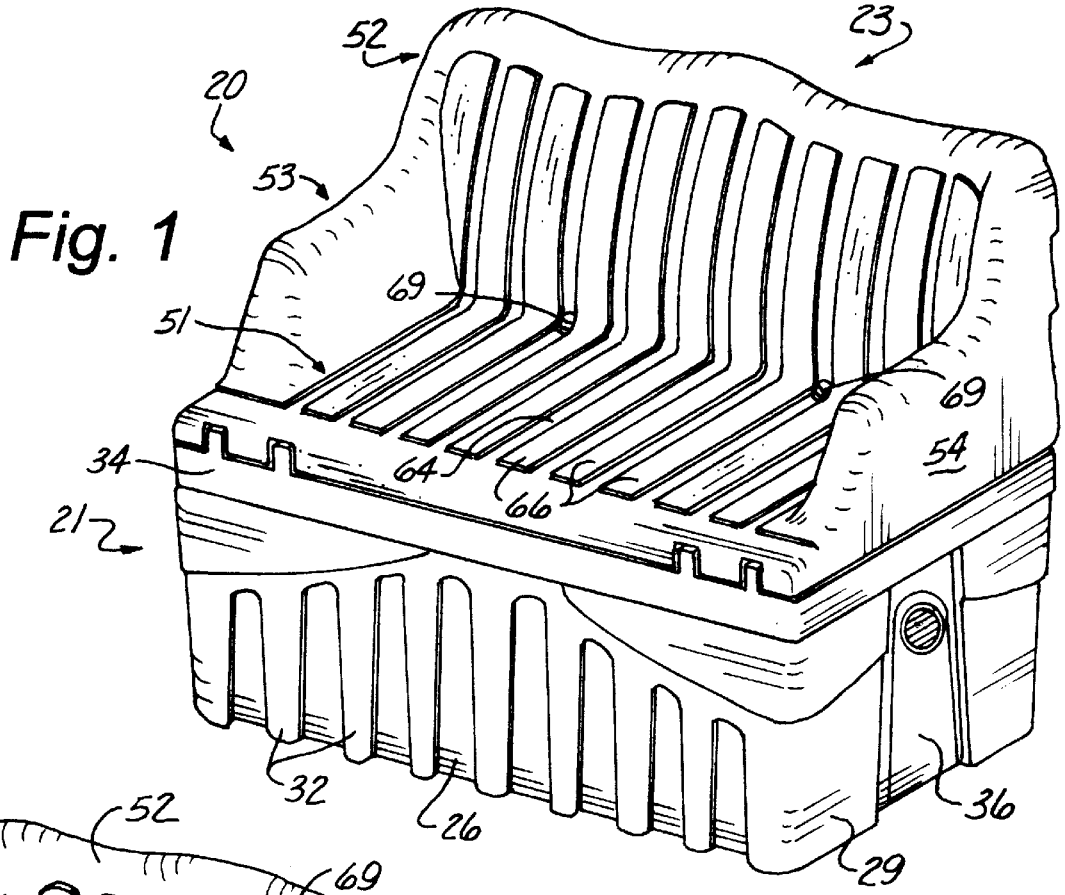
FIG. 1 is a front perspective of the combined seat bench storage apparatus of the present invention.

Referring now to FIG. 1, there is shown a front perspective view of the present combined seat bench storage apparatus. It may advantageously be used for outdoor activities involving all types of leisure uses, especially in connection with pools, docks and patios.

The apparatus provides a comfortable feel for people to enjoy as a seat bench, with back and arm rests, while providing a separate storage or locker area for many types of sports gear, for example, patio cushions, pool chemicals, fishing gear and water toys.

Figure 2:
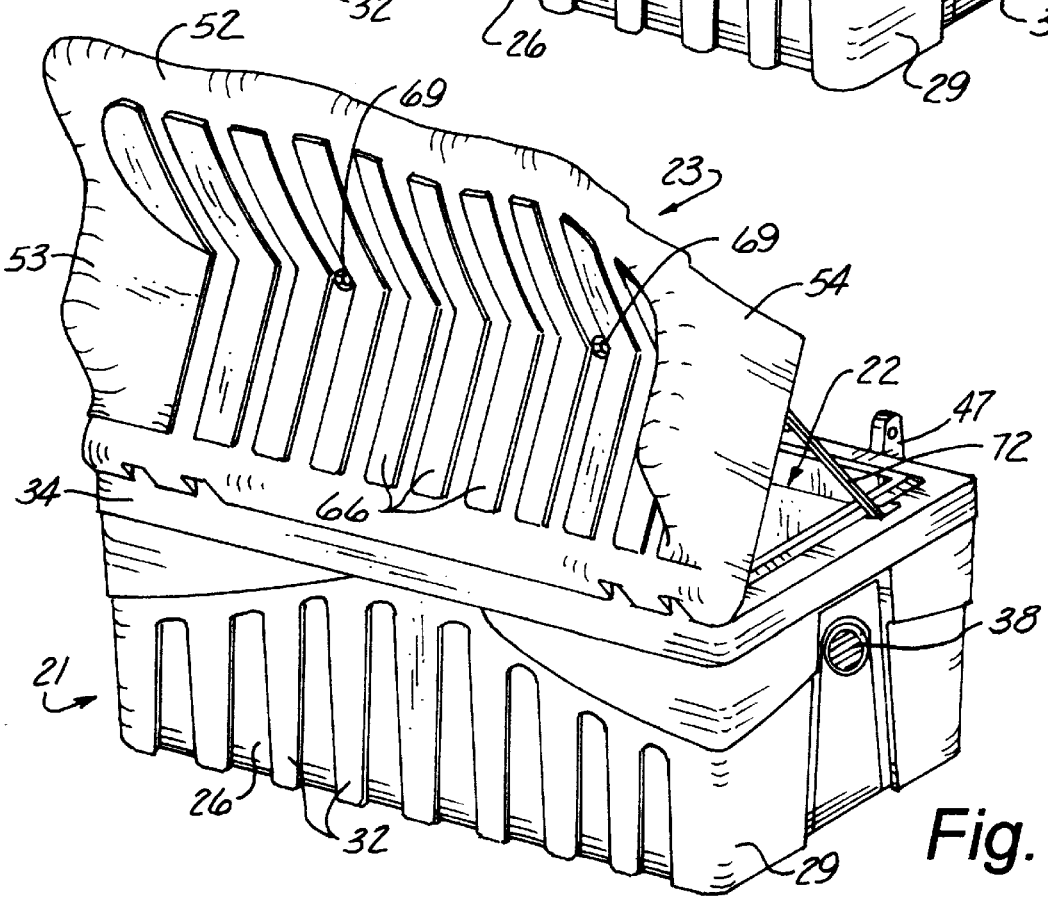
FIG. 2 is a view similar to FIG. 1, and showing the seat unit in a raised position relative to the base unit.
Figure 7:
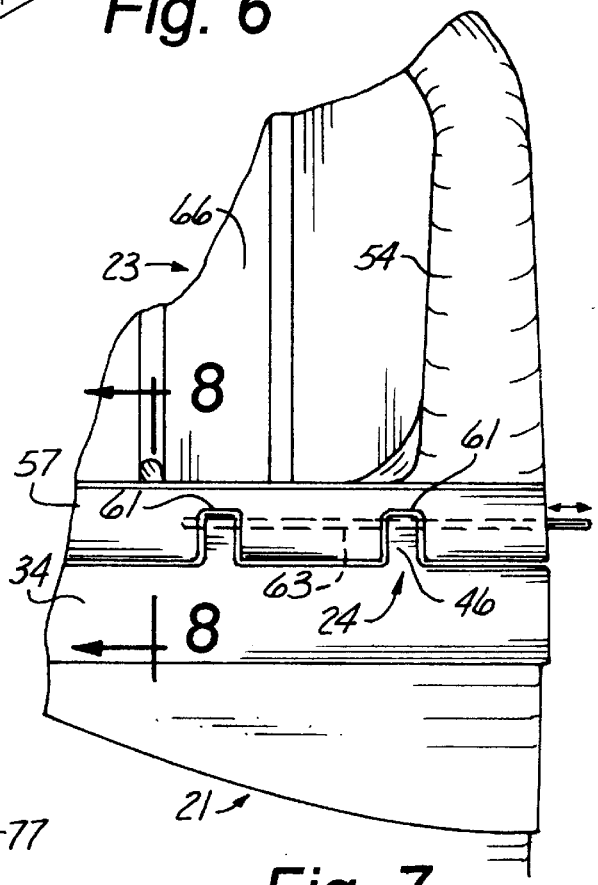
FIG. 7 is a view of the rear of the corner of FIG. 6, with the units hinged together.

The apparatus, generally indicated at (20) in FIG. 1, comprises mainly a one-piece polyethylene rotational molded base unit (21) having an open top (22) (FIG. 2), and a one-piece polyethylene rotational molded seat unit (23) hingedly connected at (24) (FIG. 7) to the base unit (21), such that the seat unit (23) is movable between the closed position with the base unit (21) (FIG. 1) and a raised condition whereby the open top (22) is exposed to the user (FIG. 2) for entry into the interior of the seat unit (23).

Figure 4:
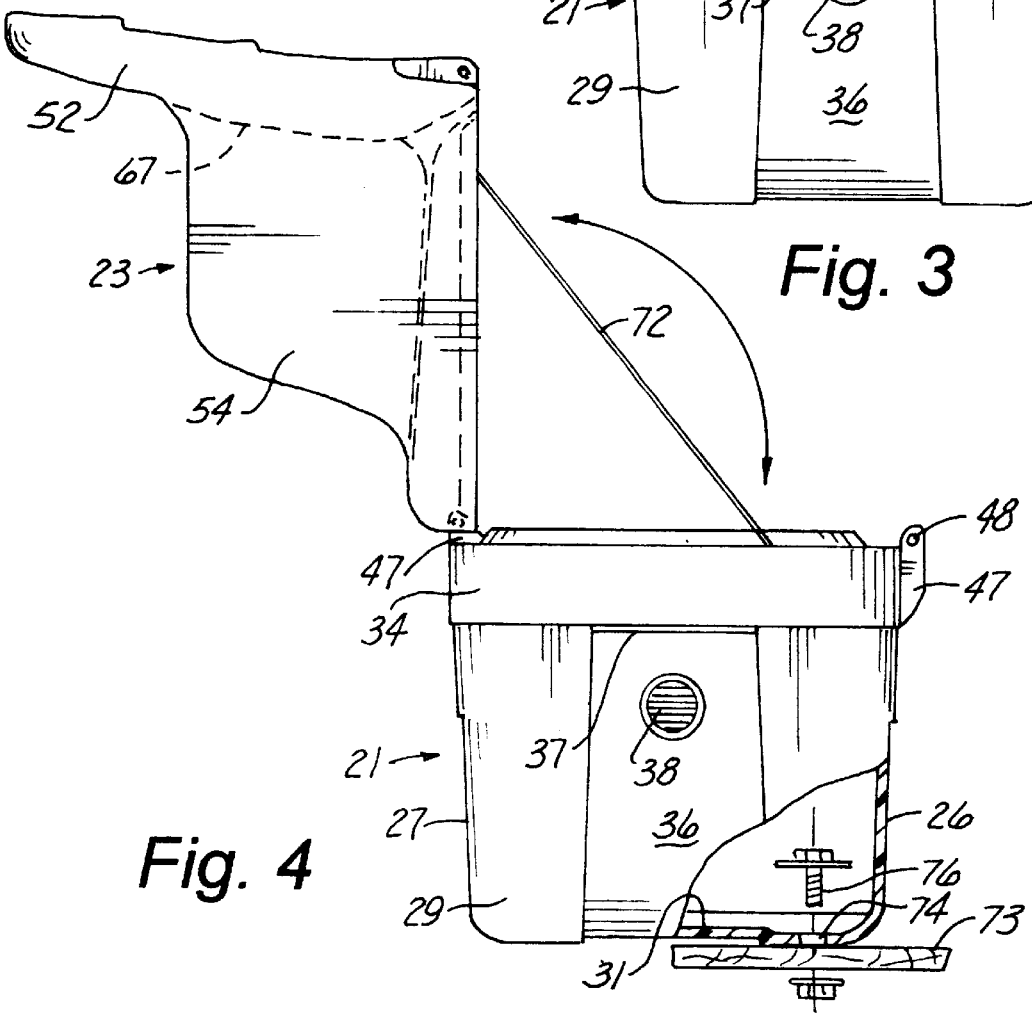
FIG. 4 is a view similar to FIG. 3 with the seat unit raised, certain parts shown in cross section for illustrative clarification.

More particularly, the base unit (21) comprises a four-sided storage locker having a front wall (26), a rear wall (27), and end walls (28), (29), the end walls (28), (29) being mirror images of each other. The base unit (21) includes as an integral part thereof, a floor (31) (FIG. 4).

Figure 3:
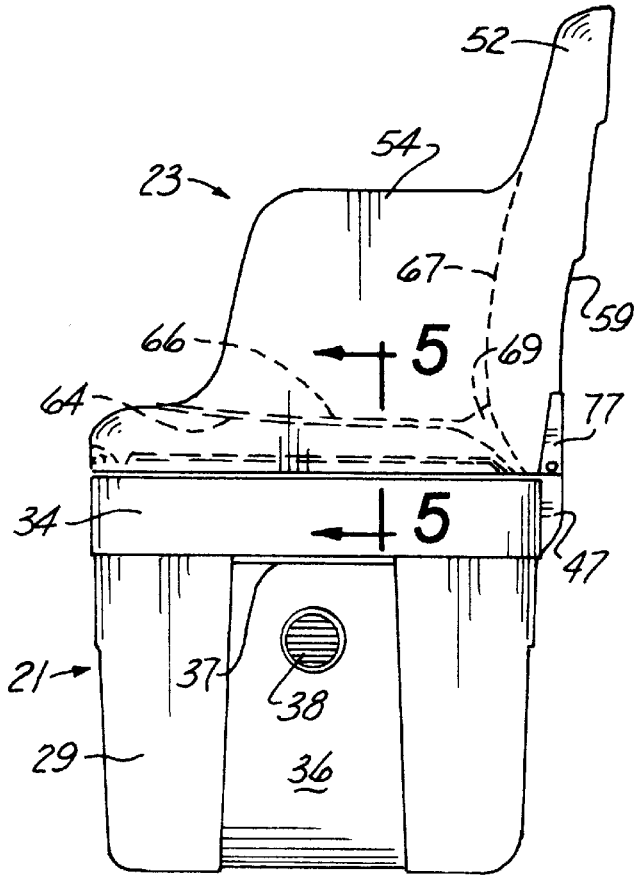
FIG. 3 is an end elevational view of the apparatus, the opposite end having a mirror image.
Figure 6:
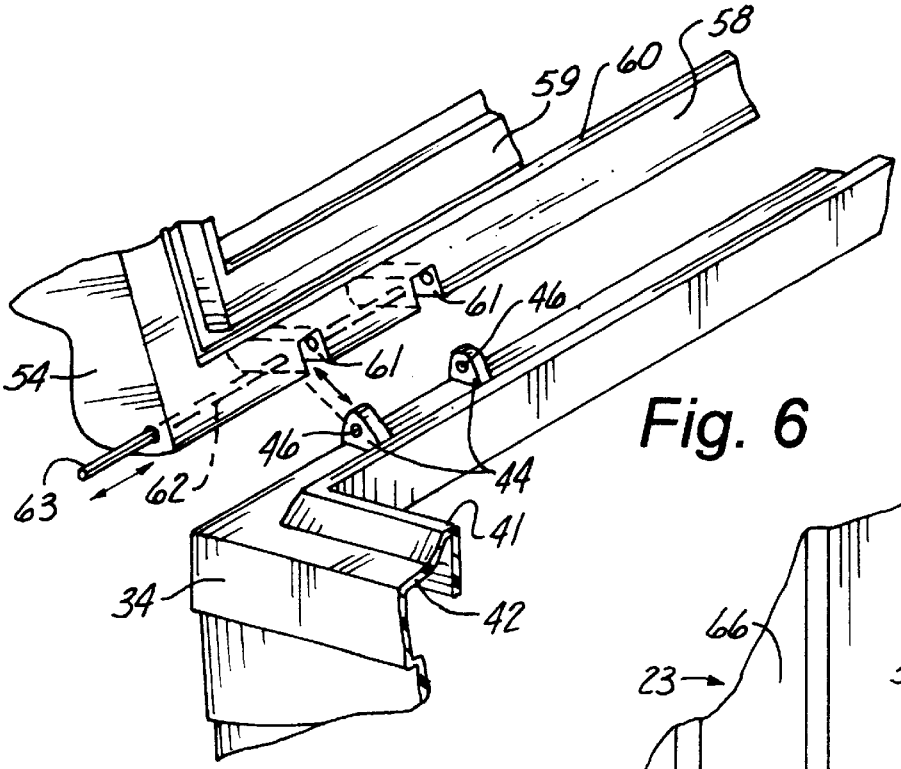
FIG. 6 is a fragmentary, exploded perspective view of an upper corner of the base unit and a lower corner of the seat unit.

For both structural and aesthetic purposes, both the front wall (26) and the rear (27) are provided with a series of vertically extended, horizontally spaced, raised panels (32), (33), respectively; and further, a horizontally disposed, inverted U-shaped band (34) (FIGS. 1 and 2) extends completely about the tops of the front, rear and walls (26–29) as a common element (see FIG. 6). At each end wall (28), (29), a panel (36) is depressed relative to the remainder of each end wall (28), (29), and also as to the outer extent of the band (34) such that a hand-hold (37) is provided for grasping and lifting the base unit (21). Referring to FIGS. 3 and 4, vent openings (38) are provided for ventilating the interior of the base unit (21).

For the purpose of providing an interlocking and sealing structure with the seat unit (23) as described more in detail hereinafter, the upper surface of lip (39) (FIG. 8) of the band (34) is provided within a raised inner edge (41) and a lowered outer edge (42), with a downwardly and outwardly sloping surface (43) joining the respective inner and outer edges (41), (42). Spaced bosses (44) (FIG. 6) with transverse openings (46) are provided adjacent each end wall (28), (29) of the base unit (21), and also adjacent each end is a raised padlock boss (47) (FIG. 9) with a transverse opening (48) formed therein.

Figure 9:
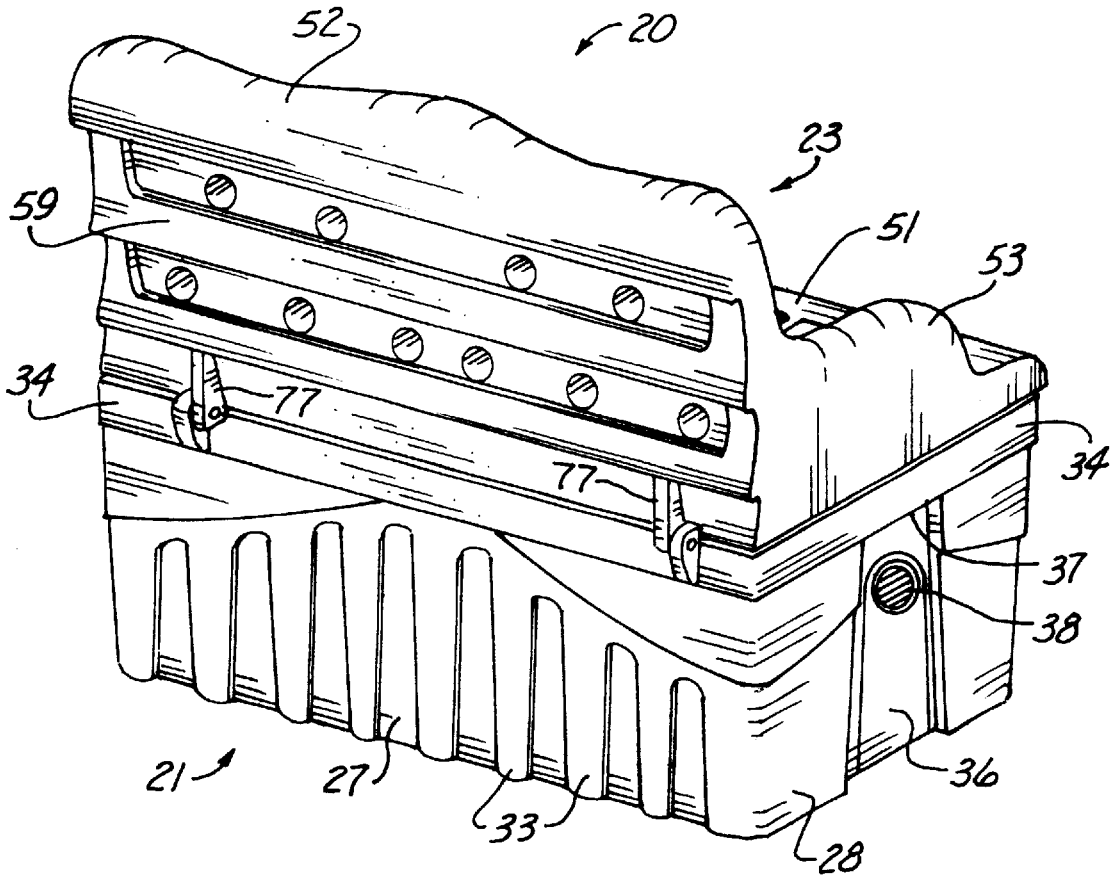
FIG. 9 is a rear perspective view of the combined seat bench storage apparatus of this invention.

The seat unit (23) includes generally a seat (51), a backrest (52), and a pair of arm rests (53), (54) at each end of the apparatus (20). Referring to FIG. 9, it will be noted that the rear surface (56) of the backrest is sculpted both horizontally and vertically to increase the structural strength of the integral seat unit (51). It will again be understood that the seat (51), backrest (52) and arm rests (53), (54) have a double wall thickness, and wherein internal reinforcing ribs or panels (not shown) may be provided for structural integrity.

Figure 5:
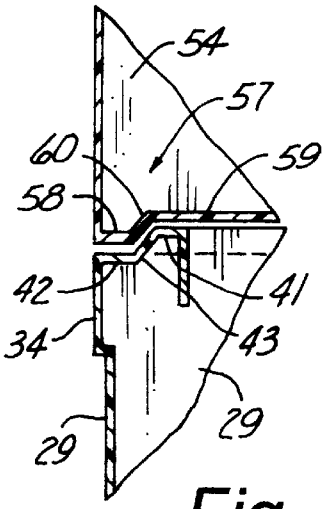
FIG. 5 is a vertical sectional view as taken along the line 5—5 in FIG. 3.

The front and end areas of the seat (51) have a common lower lip (57) (FIG. 5) with a lowered outer edge (58) and a raised inner edge (59) joined by a sloping surface (60) for a contiguous, sealing relationship with the edges (42), (41) of the base unit (21) when the latter units are closed.

For pivotal connection with the base unit (21), a pair of spaced cutouts (61) (FIG. 6) are formed in the lower front lip (57) adjacent each end thereof, and with a transverse passage (62) formed through the lip (57) and the cutouts (61), the passage (62) being accessible from exterior the lip (57). The cutouts (61) receive mating bosses (44) (FIGS. 6 and 7) of the base unit (21), and with the transverse openings (46) and passages (62) being aligned, a hinge pin (63) may be inserted therethrough, and fastened therein in any conventional manner for completing the hinged, pivotal connection.

Referring to FIG. 3, it will be noted that the upper surface (64) of the seat (51) slopes slightly downwardly and rearwardly, and as defined by horizontally spaced, slightly raised panels (66), which extend from the front of the seat (51) rearwardly to the juncture between the seat (51) and the backrest (52) (see FIG. 8), and then upwardly of the backrest, forming thereby a concave surface (67) to provide lumbar support for the user. The arrangement of the raised panels (66) in combination with the remainder of the surface of both the seat (51) and the backrest (52) provides a soft, comfortable feel for the users to enjoy.

Figure 8:
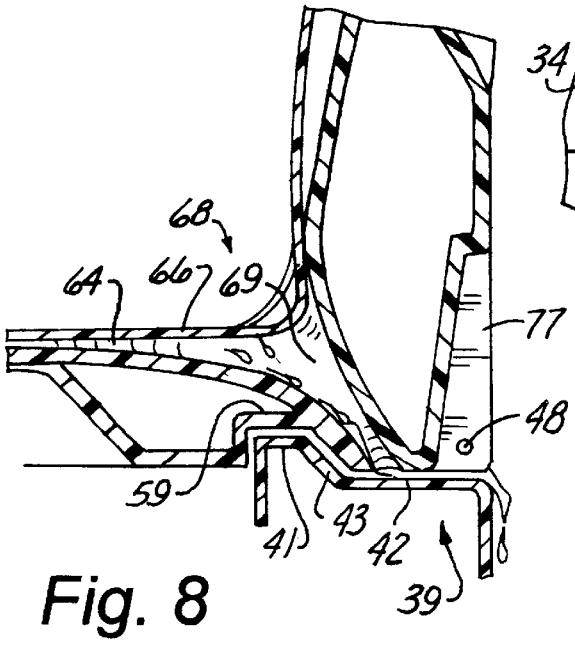
FIG. 8 is an enlarged cross section taken along the line 8—8 in FIG. 7.

Should water collect at any time on top of the seat (51) and particularly toward the juncture (68) (FIG. 8) at the rear of the seat (51) and the base of the backrest (52), the radius between the backrest (52) and the seat (51) is shaped to funnel water toward each of a pair of drain holes (69) (FIGS. 1 and 8). Thus, water tends to flow downwardly and outwardly over a curved ledge (71) as a part of each drain hole (69), the water flowing off the curved ledge (71) and onto the outer edge (42) at the rear of the seat unit (23), for discharge rearwardly off of the ledge (42).

The seat unit (23) and the base unit (21) are loosely connected by a retaining strap (72) (FIG. 4); and should it be desirable to attach the seat unit (23) onto a surface, such as the upper member (73) (FIG. 4) of a dock, appropriate openings (74) are to be drilled in the floor (31) for the passage there through of fastening devices (76). To further enhance personal comfort, a seat cushion may be secured with conventional hook and loop material into position and then later removed and stored in the under seat compartment.

Figure 10:
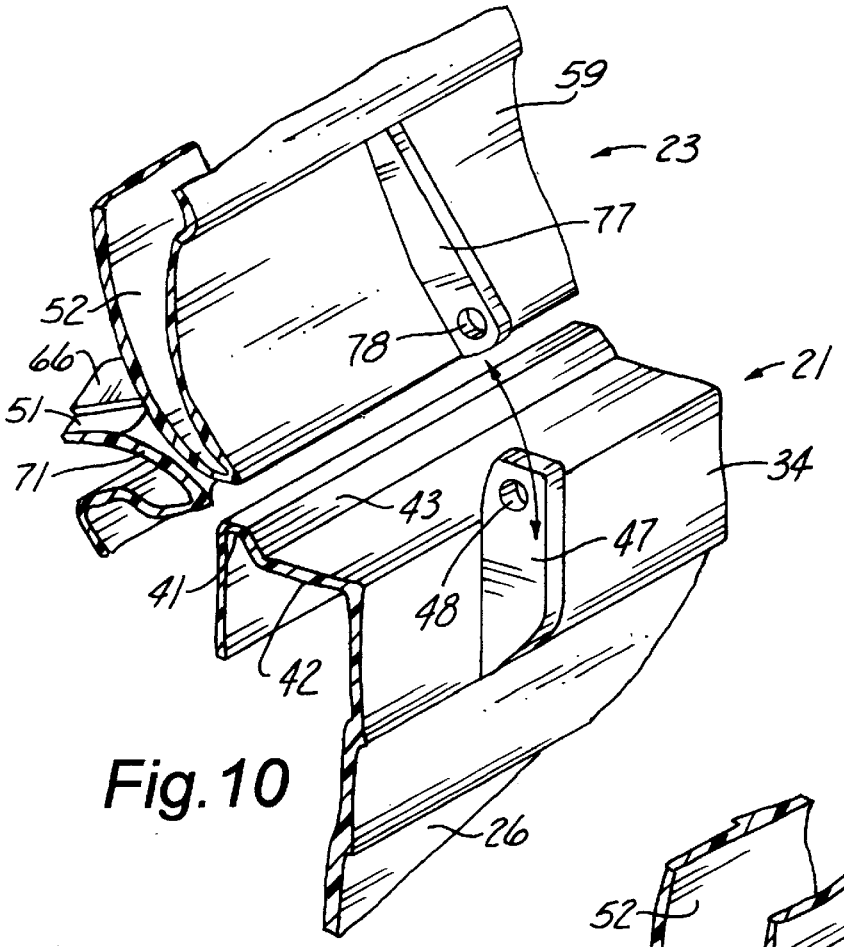
FIG. 10 is an enlarged, fragmentary sectional view of the seat unit and the base unit at a padlock boss area.
Figure 11:
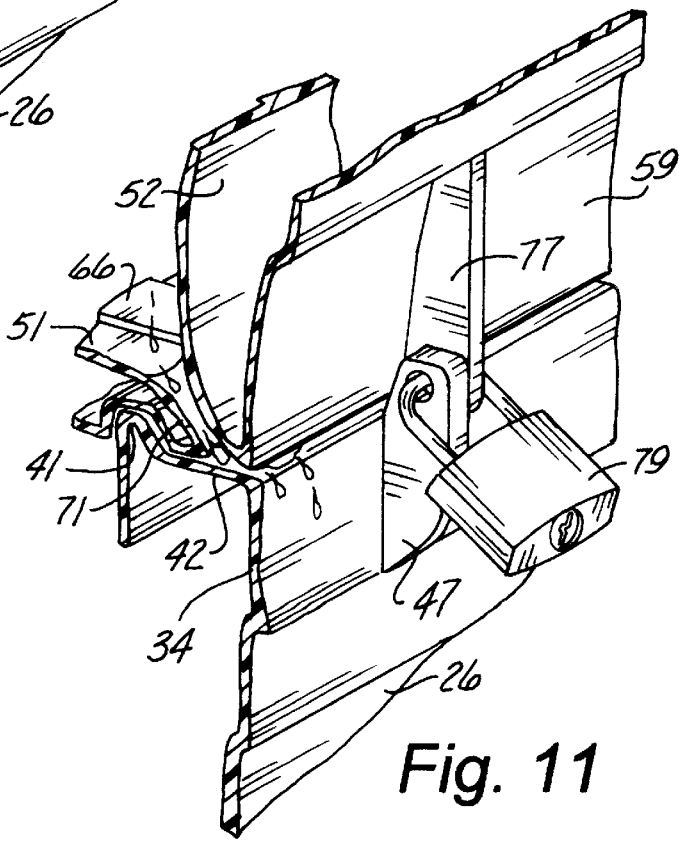
FIG. 11 is a view similar to FIG. 10, with the padlock applied.

To lock the units (21), (23) together, bosses (77) (FIG. 10) are provided adjacent each end such that upon the closed position of the seat (51) relative to the base unit (21) (FIG. 11), openings (78) provided in the bosses (77) are aligned with openings (48) in the seat unit bosses (57) such that a padlock (59) may be inserted through each pair of aligned openings (48), (78) for locking the seat unit (23) to the base unit (21).

Accordingly, it will be appreciated that the preferred embodiment shown herein will indeed accomplish the objects of this invention. Obviously, many modifications and variations of the present invention are possible in light of the above teachings. It is therefore to be understood that, within the scope of the appended claims, the invention may be practiced otherwise than as specifically described herein.

What is claimed is:

1. A seat locker assembly comprising in combination:

an integrally formed base unit having an interior locker area open at the top formed therein;

an integrally formed seat unit including a seat, a backrest and a pair of armrests; and means pivotally connecting said base unit and said seat unit together, whereby said seat unit is pivotally movable from a first position joining said base unit and closing off said open top, to a second position exposing said open top whereby said locker area may be entered; and further wherein said seat unit includes a plurality of horizontally spaced, raised panels, each panel extended from an outer front edge of said seat toward the rear thereof.

2. The seat locker assembly of claim 1, and further wherein said seat panels extend upwardly from the rear of said seat over a front surface of said backrest and forming a concave surface thereby for lumbar support.

3. A seat locker assembly comprising in combination:

an integrally formed base unit having an interior locker area open at the top formed therein;

an integrally formed seat unit including a seat, a backrest and a pair of armrests; and means pivotally connecting said base unit and said seat unit together, whereby said seat unit is pivotally movable from a first position joining said base unit and closing off said open top, to a second position exposing said open top whereby said locker area may be entered; and further wherein said base unit includes front, rear and end walls having a common upper lip with a raised inner edge and a lowered outer edge.

4. The seat locker assembly of claim 3, and further wherein a pair of hinge bosses are formed on said front wall upper lip.

5. The seat locker assembly of claim 4, and further wherein said seat has a front edge wherein spaced cavities are formed within said front edge for receiving said hinge bosses, and openings are provided within said front edge and said hinge bosses for receiving hinge pins for pivotal movement of said base unit and said seat unit.

6. The seat locker assembly of claim 3, and further wherein said seat has common upper front and side lips with a lowered outer edge and a raised inner edge forming an interlocking lip unit with said base unit lip.

7. The seat locker assembly of claim 3, and further where one or more drain openings are formed at the juncture of said seat and said backrest whereby fluid may flow from said seat through said openings and onto said upper lip lowered outer edge for discharge rearwardly thereof.

8. A seat locker assembly comprising in combination:

an integrally formed base unit having an interior locker area open at the top formed therein;

an integrally formed seat unit including a seat, a backrest and a pair of armrests; and means pivotally connecting said base unit and said seat unit together, whereby said seat unit is pivotally movable from a first position joining said base unit and closing off said open top, to a second position exposing said open top whereby said locker areas may be entered; and further wherein one or more bosses are formed on rear upper and lower surfaces of said base unit and said seat unit, respectively, with transverse openings formed in said basses for alignment, whereby said units my be locked together as by a padlock inserted through said aligned transverse openings.

9. A seat locker assembly comprising in combination:

an integrally formed base unit having an interior locker area open at the top formed therein;

an integrally formed seat unit including a seat, a backrest and a pair of armrests; and means pivotally connecting said base unit and said seat unit together, whereby said seat unit is pivotally movable from a first position joining said base unit and closing off said open top, to a second position exposing said open top whereby said locker area may be entered:

further wherein said base unit includes end panels each having a hand hold formed along an upper end thereof for aiding in carrying the assembly; and further wherein an air vent is formed in each end panel below said hand hold for providing ventilation to said interior locker area.

* * * * *